US005456644A

United States Patent [19]

Hecox et al.

[11] Patent Number: 5,456,644

[45] Date of Patent: Oct. 10, 1995

[54] MULTIPLE STATION EXERCISE MACHINE HAVING RELOCATABLE TORSION RESISTANCE MECHANISMS

[75] Inventors: Mark G. Hecox, Tyler, Tex.; Richard W. Trevino, Shreveport, La.

[73] Assignee: Roadmaster Corp., Olney, Ill.

[21] Appl. No.: 140,289

[22] Filed: Oct. 20, 1993

[51] Int. Cl.[6] ..... A63B 21/045

[52] U.S. Cl. ..... 482/127; 482/138; 482/130; 482/137

[58] Field of Search ..... 482/127, 129, 482/130, 138, 49, 135, 136, 137

[56] References Cited

U.S. PATENT DOCUMENTS

| | | | |
|---|---|---|---|
| D. 335,511 | 5/1993 | Engel et al. . | |
| 2,855,199 | 11/1958 | Noland et al. . | |
| 3,336,021 | 8/1967 | Kramer . | |
| 3,545,737 | 12/1970 | Lamprey . | |
| 3,976,058 | 8/1976 | Tidwell . | |
| 4,072,309 | 2/1978 | Wilson . | |
| 4,171,920 | 10/1979 | Kramer et al. . | |
| 4,331,496 | 5/1982 | Orndorff, Jr. . | |
| 4,465,274 | 8/1984 | Davenport | 482/138 |
| 4,502,681 | 3/1985 | Blomqvist . | |
| 4,566,691 | 1/1986 | Mahnke . | |
| 4,582,320 | 4/1986 | Shaw . | |
| 4,585,359 | 4/1986 | Kramer . | |
| 4,600,189 | 7/1986 | Olschansky et al. . | |
| 4,627,619 | 12/1986 | Rockwell et al. . | |
| 4,666,149 | 5/1987 | Olschansky et al. . | |
| 4,677,721 | 7/1987 | Kramer . | |
| 4,714,220 | 12/1987 | Hillstrom et al. . | |
| 4,768,761 | 9/1988 | Kramer . | |
| 4,778,199 | 10/1988 | Haggerty et al. . | |
| 4,798,377 | 1/1989 | White | 482/49 |
| 4,840,373 | 6/1989 | Maag | 482/136 |
| 4,850,586 | 7/1989 | Horvath . | |
| 4,854,578 | 8/1989 | Fulks . | |
| 4,880,319 | 11/1989 | Haggerty . | |
| 4,902,007 | 2/1990 | Ferrari | 482/138 |
| 4,927,007 | 5/1990 | Kramer . | |
| 4,979,736 | 12/1990 | Maynard . | |
| 5,002,271 | 3/1991 | Gonzales . | |
| 5,007,660 | 4/1991 | Orndorff, Jr. et al. . | |
| 5,066,004 | 11/1991 | Jones . | |
| 5,120,289 | 6/1992 | Yu | 482/138 |
| 5,129,873 | 7/1992 | Henderson et al. . | |
| 5,160,305 | 11/1992 | Lin . | |
| 5,211,617 | 5/1993 | Millen . | |
| 5,277,684 | 1/1994 | Harris . | |

OTHER PUBLICATIONS

Diversified Products "Fit for Life" Brochure, published by Diversified Products, Dec. 1991, 6 pages.

*Primary Examiner*—Lynne A. Reichard

[57] ABSTRACT

An exercise apparatus comprising a frame, a pivot arm mounted on the frame, a resistance mechanism, preferably an elastomeric torsion member, and a positioning element which allows the pivot arm to be pivotally adjusted with respect to the frame, independent of the resistance element, so as to vary the neutral position of the pivot arm. The preferred embodiment may also comprise a shaft mounted to the frame for conveying torque to the elastomeric torsion member and a support arm mounted to the frame to oppose rotation of the elastomeric torsion member about the shaft. In one embodiment, the exercise apparatus takes the form of a weight bench. In a second embodiment, the exercise apparatus is a home gym.

16 Claims, 10 Drawing Sheets

MULTIPLE STATION EXERCISE MACHINE HAVING RELOCATABLE TORSION RESISTANCE MECHANISMS

BACKGROUND OF THE INVENTION

The present invention relates to resistance machines for exercise. The prior art is replete with examples of exercise machines. Exercise machines known in the art, such as weight benches, often comprise a frame with a shaft and a pivot arm attached to it. Weights are loaded on the shaft. The pivot arm functions as a handle for the person exercising. In some machines, the exerciser has the option of moving the handle to one of several positions before using the machine. This option enables the user to exercise several different muscle groups with the same machine. In order to move the pivot arm of the weight benches presently known in the art, the exerciser must remove the weights on the shaft, adjust the handle and replace the weights before beginning to exercise. This process is tedious and time consuming. The person exercising wastes valuable time removing and replacing weights. An exercise machine that does not require removing the weights to adjust the pivot arm would save exercisers' time and also increase their enjoyment of the machine.

Prior art exercise machines commonly provide weights as a source of resistance. However, resistive force may also be created by different mechanisms. Rubber elements used as stretchable members have been widely used to oppose motion of certain mechanisms in an exercise machine. Many of the resistance mechanisms known in the art are complicated and cumbersome. An exercise machine that is easy to adjust so that different muscle groups can be exercised, and that is simple and durable, would be a welcome improvement.

SUMMARY

In the first aspect, the resistance machine of the present invention includes a frame, a pivot arm mounted on the frame, a resistance mechanism and a positioning element which allows the pivot arm to be pivotally adjusted with respect to the frame, independent of the resistance element, so as to vary the neutral position of the pivot arm. In the preferred embodiment, the resistance mechanism is a torsion elastic spring.

In the second aspect, the exercise apparatus of the present invention embodies a frame, at least one elastomeric torsion member for creating resistance, a shaft mounted to the frame for conveying torque to the elastomeric torsion member, a support arm mounted on the frame for opposing rotation of the elastomeric torsion member about the axis of the shaft and a pivot arm mounted on the frame and connected to the shaft so that movement of the pivot arm is resisted by the elastomeric torsion member.

In the third aspect, the exercise apparatus of the present invention includes a frame, a pivot arm pivotally connected to the frame, at least one arm lever attached to the pivot arm by a pivot axis which allows the arm lever to rotate with respect to the pivot arm, at least one resistance mechanism connected to the arm lever to resist rotation of the arm lever with respect to the pivot arm, and a lock-out mechanism to prevent the pivot arm from pivoting with respect to the frame.

In the fourth aspect, the exercise apparatus of the present invention embodies a frame, a cross bar attached to the frame, two arm levers, each connected to the cross bar by a pivot axis, and two torsion elastic springs mounted on the frame, each torsion elastic spring opposing rotation one of the arm levers with respect to the cross bar.

One of the advantages of the invention is that the positioning element makes the exercise machine extraordinarily easy to use and conditions different muscle groups. Another advantage lies in the simplicity and durability of the resistance mechanism.

These and other advantages, as well as the invention itself, will be best understood in view of the attached drawings, a brief description of which follows.

DETAILED DESCRIPTION OF THE DRAWINGS AND PREFERRED EMBODIMENTS OF THE INVENTION

Figure 1:
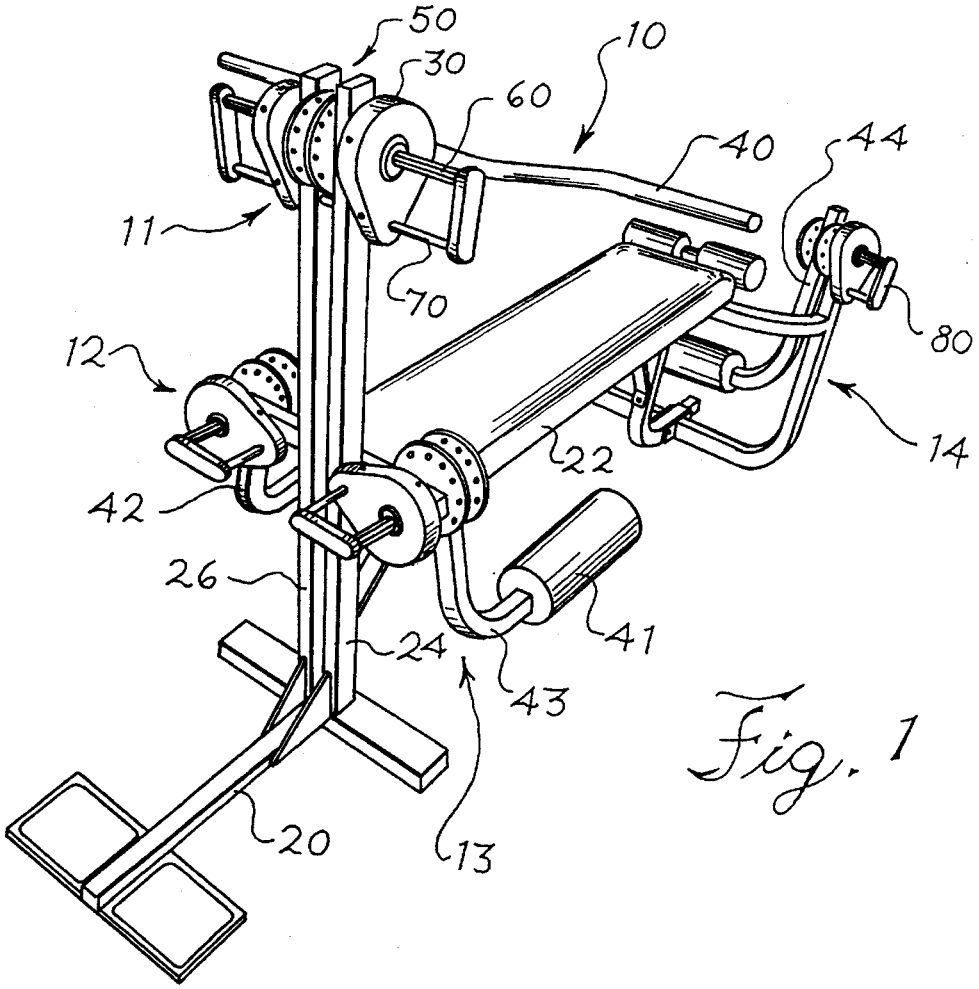
FIG. 1 is a perspective view of a first preferred embodiment of the exercise apparatus of the present invention.

Referring initially to FIG. 1, a preferred embodiment of the resistance machine for exercise of the present invention is a weight bench 10. As illustrated, the weight bench 10 includes a frame 20. The frame 20 supports a longitudinally extending bench 22 with a pair of upright members 24 and 26 mounted to one end of the bench and a third leg 25 mounted at the opposite end of the bench. Upright members 24 and 26 each extend upwardly to support various elements of the invention which will be described hereafter. It should be understood that the particular shape of the frame 20 is not critical to the present invention. The frame 20 provides a surface for mounting other members and a base 23 which prevents the machine 10 from tipping during use.

The embodiment of FIG. 1 also includes four exercise stations, 11, 12, 13, and 14 which each include a resistance mechanism 30 and a pivot arm 40, 42, 43 or 44. Exercise station 11 is used for exercising the upper body, specifically the chest muscles. Exercise stations 12 and 13 are used to condition the arms. Exercise station 14 is used to exercise the leg muscles. In other embodiments of the invention, fewer or more exercise stations may be mounted on the frame. The pivot arm 40, 42, 43 or 44 of each exercise station may have a cushioning pad 41 surrounding its free end which provides comfort to the exerciser. Movement of the pivot arm 40, 42, 43 or 44 is opposed by the resistance mechanism 30. A positioning element 50 allows the pivot arm 40, 42, 43 or 44 to be adjusted with respect to the frame 20, independent of the resistance mechanism 30, so as to vary the neutral position of the pivot arm 40, 42, 43 or 44.

At each exercise station there is a shaft 60 and a support arm 70 attached to the frame 20. The shaft 60 and support arm 70 are inserted into corresponding apertures in the frame 20 and are thus held securely in place.

Figure 2:
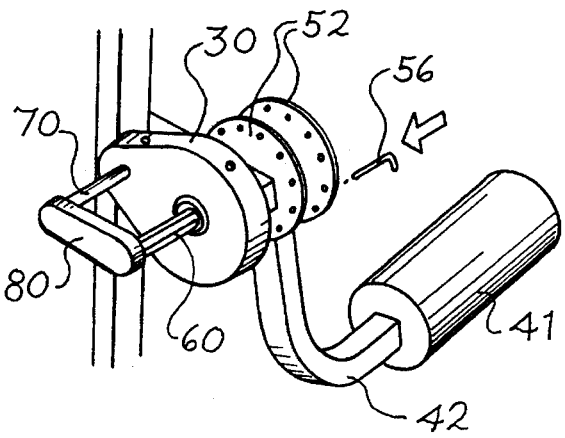
FIG. 2 is a perspective view of the pivot arm and positioning element of FIG. 1 in a first position.
Figure 3:
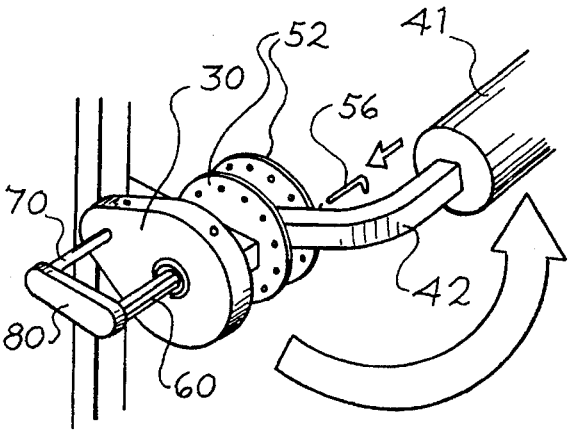
FIG. 3 is a perspective view of the pivot arm and positioning element of FIG. 1 in a second position.

FIGS. 2 and 3 illustrate how the pivot arm 40 may be adjusted without moving the resistance mechanism 30. In FIG. 2, the pivot arm 40 is in a first position. In the preferred embodiment, the positioning element 50 consists of two disk-shaped plates 52 with the pivot arm 40 mounted in between them. When it becomes necessary to move the pivot arm 40 to perform a different exercise, one merely removes the pin 56 from the positioning plates 52, moves the pivot arm 40 to another position and reinserts the pin 56 into the positioning plates 52. In the preferred embodiment, pivot arm 40 also possesses a corresponding hole for receiving the pin 56. FIG. 3 illustrates the pivot arm 40 in a second position.

Figures 4, 5, 6:
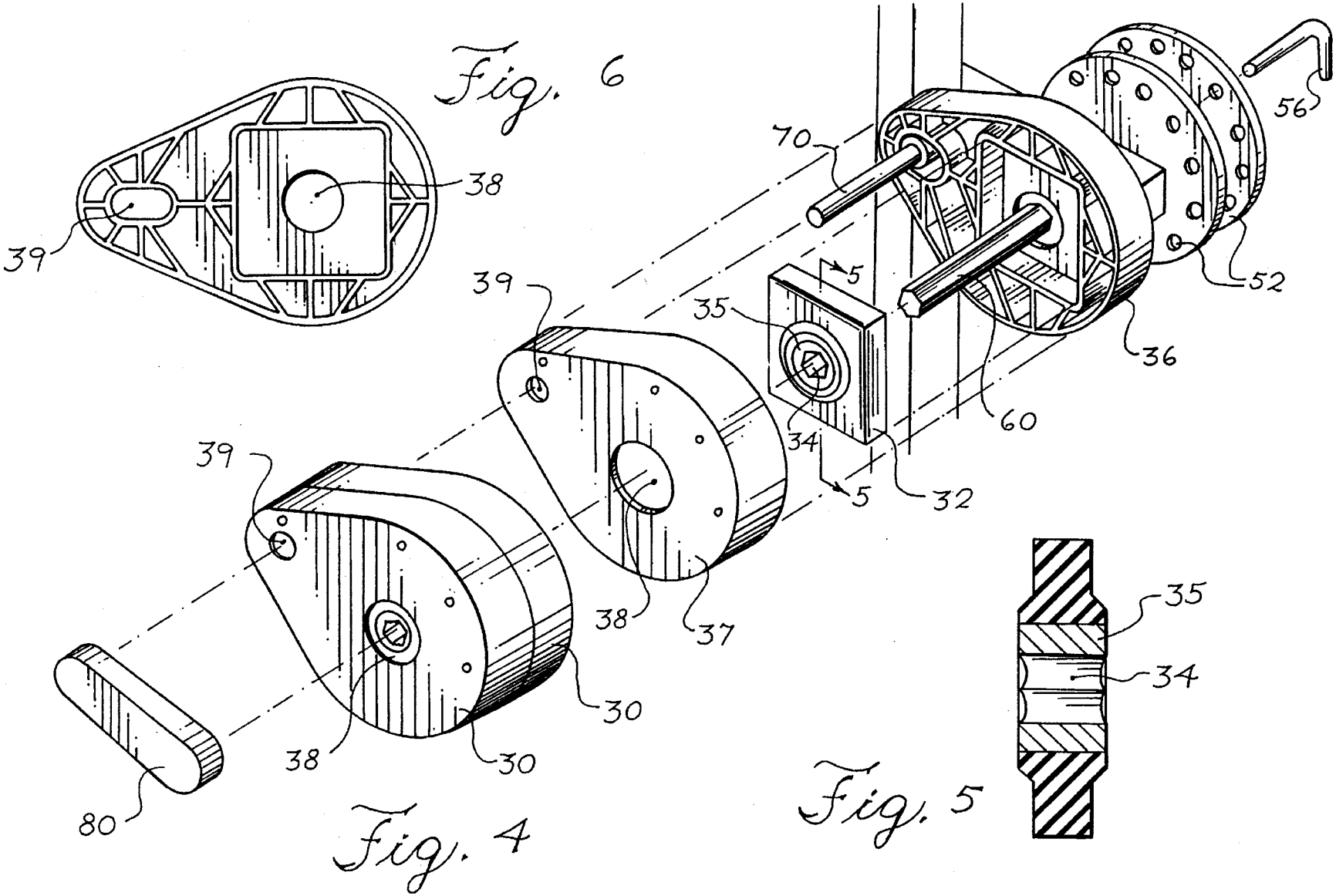
FIG. 4 is an exploded view of the preferred resistance mechanism of FIG. 1.
FIG. 5 is a cross-sectional view of the torsion elastic spring of FIG. 4.
FIG. 6 is a perspective view of the torsion elastic spring casing of FIG. 4.

The various components of the preferred resistance mechanism 30 are depicted in FIG. 4. The primary component of the resistance mechanism 30 is a torsion elastic spring 32. In the preferred embodiment, the torsion elastic spring 32 has a square shape with a central bore 34 that is lined with a casing 35. In the preferred embodiment, the casing 35 is rigid and corresponds to the shape of the shaft 60. Most preferably, the casing 35 inside the central bore 34 is aluminum and has a hexagonal internal shape. See FIG. 5. A preferred torsion elastic spring with such a core is sold by the B. F. Goodrich Company, 6061 B. F. Goodrich Boulevard, Blount Island, Jacksonville, Fla., 32226 under the trademark TORSILASTIC®.

The torsion elastic spring 32 is placed into a plastic casing consisting of two halves 36 and 37. As depicted in FIG. 6, the casing is ribbed to provide structure and support to the torsion elastic spring 32. The two halves 36 and 37 are symmetrically shaped, each containing a central aperture 38 for receiving a shaft 60. The two halves 36 and 37 also possess an aperture 39 at the bottom of the casing which receives support arm 70. The support arm 70 prevents the rotation of the torsion elastic spring 32 about the axis of the shaft 60. The casing is designed to transmit force between the torsion elastic spring 32 and the aperture 39.

Before the resistance mechanism 30 is loaded onto the frame 20, the torsion elastic spring 32 is put into one half of the casing 36. The other half of the casing 37 is then placed over the first half of the casing 36 and the torsion spring 32. The two halves of the casing 36 and 37 are then held together by an appropriate means. In the preferred embodiment, screws are inserted into corresponding holes in the casing. See FIG. 4. The assembled resistance mechanism 30 may then be positioned onto the shaft 60 and the support arm 70. Preferably, the cross-section of the shaft 60 and the casing 35 lining the central bore 34 of the torsion elastic spring 32 have a corresponding shape. Most preferably, the shaft 60 and casing 35 are both hexagonally shaped. This design enables the shaft 60 to convey torque to the torsion elastic spring 32. After the desired number of resistance mechanisms 30 are placed onto the frame 20, an end cap 80 may optionally be positioned over the end of both the shaft 60 and support arm 70 as a safety measure. The casing 35 preferably has chamfered edges as shown in FIG. 5 to allow for easier placement of the torsion elastic spring 32 onto shaft 60.

The amount of resistance produced by the torsion elastic spring 32 is a function of the length of the moment arm and the durameter and other properties of the rubber. The casing 35 inside the central bore 34 of the torsion elastic spring 32 affects the length of the moment arm and therefore must factor into the design specifications. Thus different configurations of the torsion elastic member may be used to provide different levels of resistance. Hence, one resistance element could provide the equivalent of 10 lbs. of resistance, and another 5 lbs. of resistance. A user desiring the equivalent of 25 lbs. of resistance would then use two 10 lb. and one 5 lb. equivalent resistance elements on shaft 60.

The weight bench 10 will be better understood by explaining the mechanics of each exercise station. Referring to the first exercise station 11, the user either sits or lies on bench 22 after adjusting pivot arm 40 to the position corresponding to the desired exercise. The user then pushes upward on pivot arm 40. The forces transmitted through positioning pin 56 and plates 52 consequently rotate shaft 60. The rotation of shaft 60 causes the inner rubber of the torsion elastic spring 32 to rotate. Outer casing 36, 37 of the torsion elastic spring 32 is secured to support arm 70. The support arm 70 opposes the rotation of the elastomeric torsion member 32 about the axis of the shaft 60. Torsion elastic spring 32 thus resists the movement of pivot arm 40 and returns it to its neutral position.

Exercise stations 12 and 13 may be utilized either separately or together. An example of one exercise capable of being performed by exercise stations 12 or 13 occurs when the user lies face down on bench 22 and places both arms under pivot arms 42 and 43. The user's forearms rest along cushioning pads 41. The user pushes the pivot arms 42, 43 upward until they are even with the user's shoulders. This causes rotation of the positioning pin, positioning plates, shafts and torsion elastic springs of exercise stations 12 and 13. The support arms of these two stations 12, 13 oppose the rotation of the torsion elastic springs 32. This exercises may be performed when the user is lying on either his back or his stomach. As stated earlier, this same exercise may be practiced using either exercise station 12 or 13 independently.

Finally, exercise station 14 conditions the leg muscles. The user adjusts pivot arm 44 to a downward position. The user sits on bench 22 so that the user's knees are at the end of the bench 22 and the user's legs are behind cushioning pad 41 of pivot arm 44. The user pushes the lower legs upward until they are almost even with the upper legs. Alternatively, the user may position pivot arm 44 in an upward position and lie on bench 22 so that the user's ankles are underneath cushioning pad 41. The user bends the legs backwards so that pivot arm 44 is pulled towards the user's buttocks. Both of the above described exercises may be performed using a single leg. Both exercises result in rotation of pivot arm 44 which causes the positioning pin, positioning plates, shafts and torsion elastic springs to rotate. Again, the support arm opposes the rotation of the torsion elastic spring.

Figure 7:
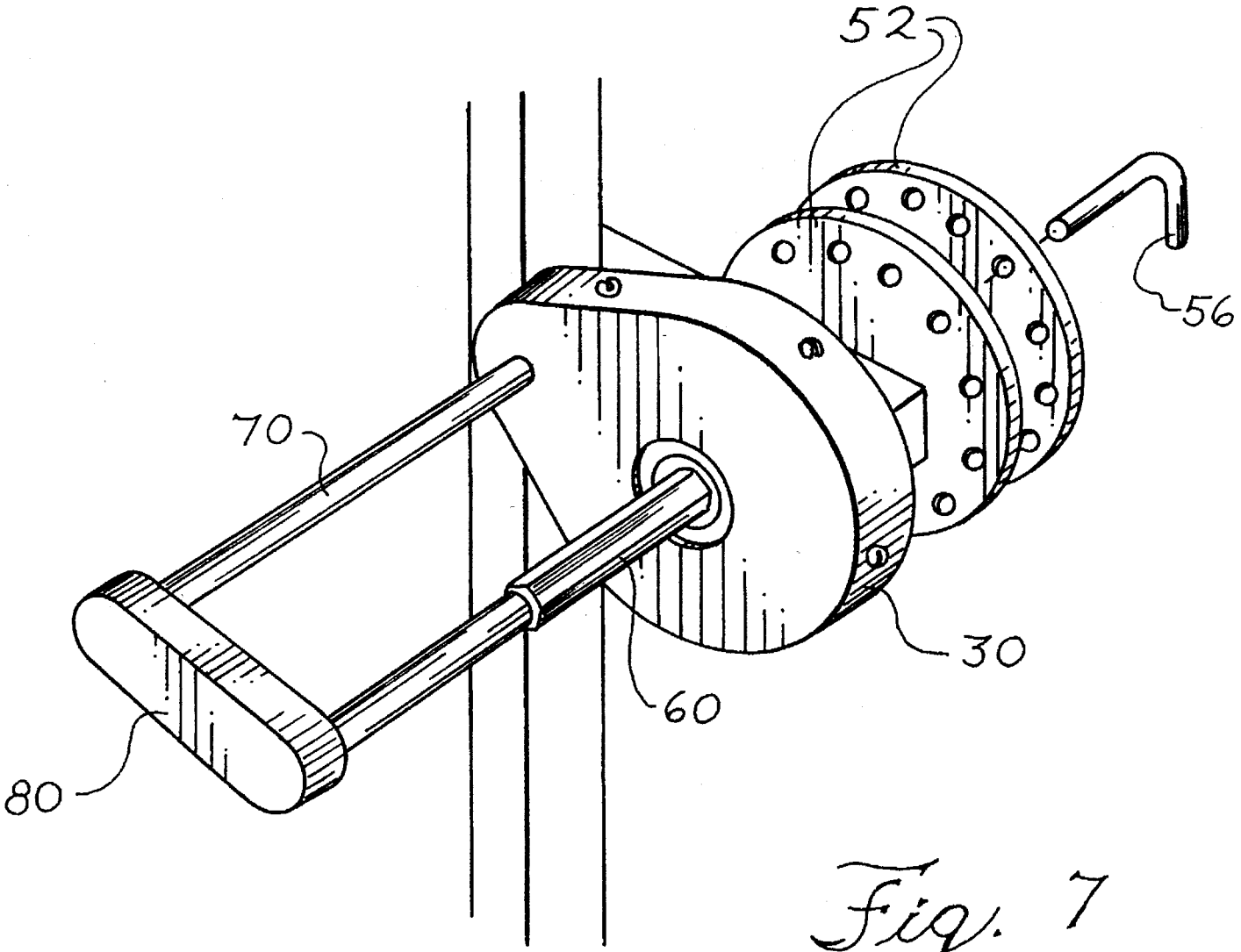
FIG. 7 is a perspective view of a second embodiment of the hexagonally shaped shaft of FIG. 1.

One variation of the preferred embodiment of the invention, illustrated in FIG. 7, lies in modifying the shaft 60 so that it has a hexagonal cross-section through its body and becomes rounded on its ends. This modification allows the exerciser to change the resistance on the machine 10 without completely removing or replacing the resistance mechanisms 30. A predetermined number of resistance mechanisms 30 are placed on the shaft 60 at its rounded end. Since the casing 35 inside the central bore 34 of the torsion elastic spring 32 is hexagonal, the torsion elastic spring 32 does not engage the shaft 60 in this position. The amount of resistance is changed by sliding the appropriate number of resistance mechanisms on to the hex-shaped part of the shaft 60, thereby engaging the torsion elastic spring 32 inside the resistance mechanism. The advantage of this variation is that it allows the exercisers to make more efficient use of their time since they do not have to remove or replace the resistance elements on the machine 10. This inherently leads to increased satisfaction with the machine 10.

Figure 8:
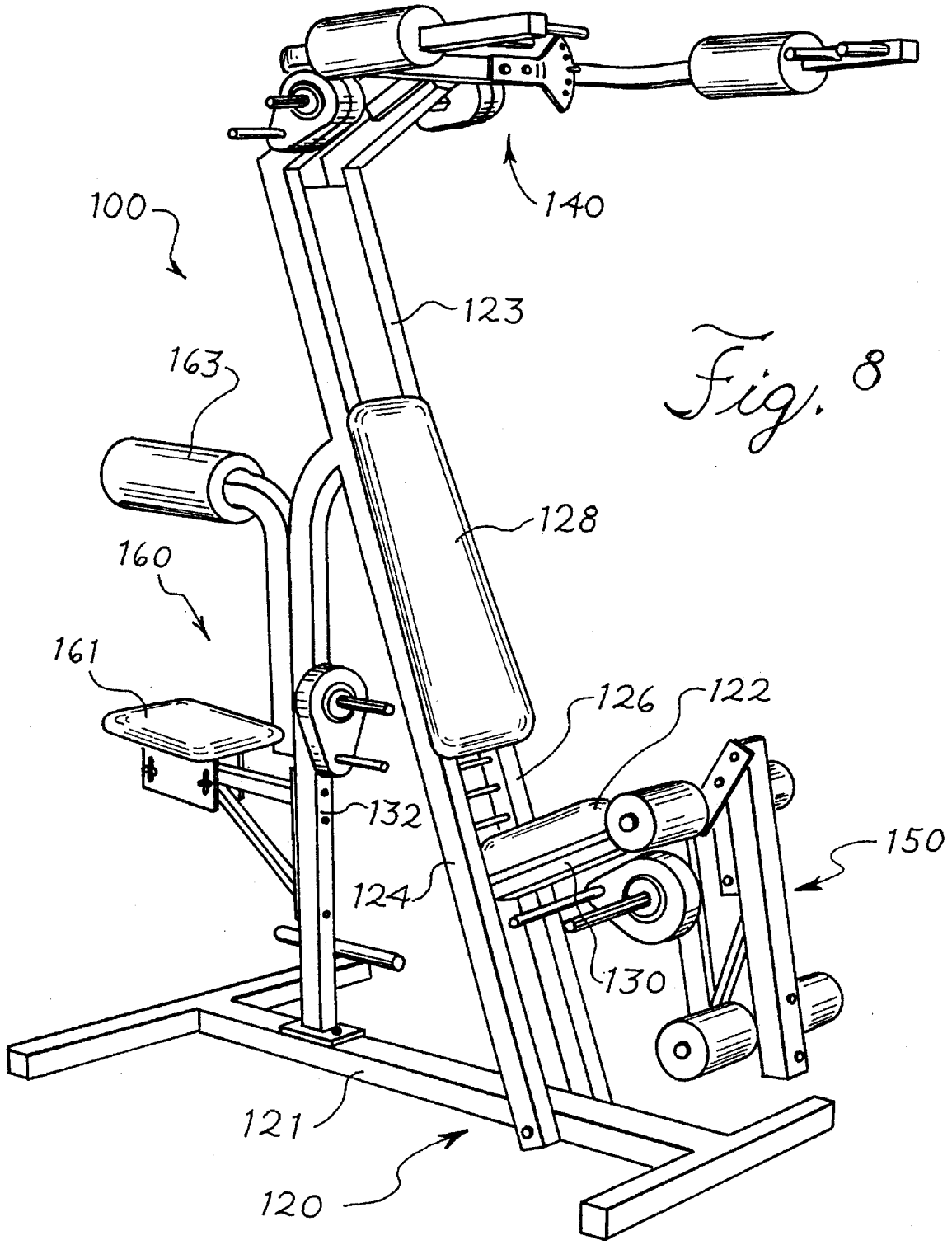
FIG. 8 is a perspective view of a second preferred embodiment of the exercise apparatus of the present invention.

Referring now to FIG. 8, a second embodiment of the present invention is a multiposition home gym. As illustrated, the home gym 100 includes a frame 120. The frame includes base 121 as well as two upright members. The first upright member 123 is comprised of two spaced, parallel bars 124 and 126. Upright member 123 extends upwardly to support a first exercise station 140 which will be described hereafter. The upright member 123 also supports a back pad 128. The first seat 122 rests on member 130 which is mounted between bars 124 and 126. The first upright member 123 is comprised of two spaced, parallel bars. Member 130 supports a second exercise station 150 at its opposite end. A second upright member 132 extends upwardly from frame base 121 and intersects upright member 123 at a midpoint of the first upright member 123. Upright member 132 supports a third exercise station 160.

Referring now to the details of each exercise station, the first exercise station 140 is depicted in FIGS. 9A–9D. This station includes a resistance mechanism 141 and a pivot arm 142. In the preferred embodiment, pivot arm 142 is connected to the center of a bar 242 which acts as a cross member and projects laterally in opposite directions. Each end of the bar 242 connects to an arm lever 143, 144. Arm levers 143, 144 are attached to the bar 242 by a pivot axis 145 which allows the lever to rotate with respect to the bar 242. Positioning plate 149 and corresponding pin 249 lock arm levers 143, 144 in position for certain exercises. Each arm lever 143 and 144 may also have a pair of hand grips 146 and a cushioning pad 147.

Movement of the pivot arm 142 is opposed by the resistance mechanism 141. A positioning element 148 allows the pivot arm to be adjusted with respect to the frame 120, independent of the resistance mechanism 141, so as to vary the neutral position of the pivot arm 142. Positioning elements 148 and 149 operate in the same fashion as position element 50 of the weight bench 10. The combination of variations of the neutral position of the pivot arm 142 and the arm levers 143, 144 allow the user to perform a variety of exercises. In a preferred embodiment, the holes of positioning plates 148 are labeled with the exercise performed when pivot arm 142 is locked into that position. The resistance mechanism 141 may be positioned either vertically on the top of upright member 123 (FIG. 9A) or horizontally, on pivot axes 145 (FIG. 9D).

Figure 10:
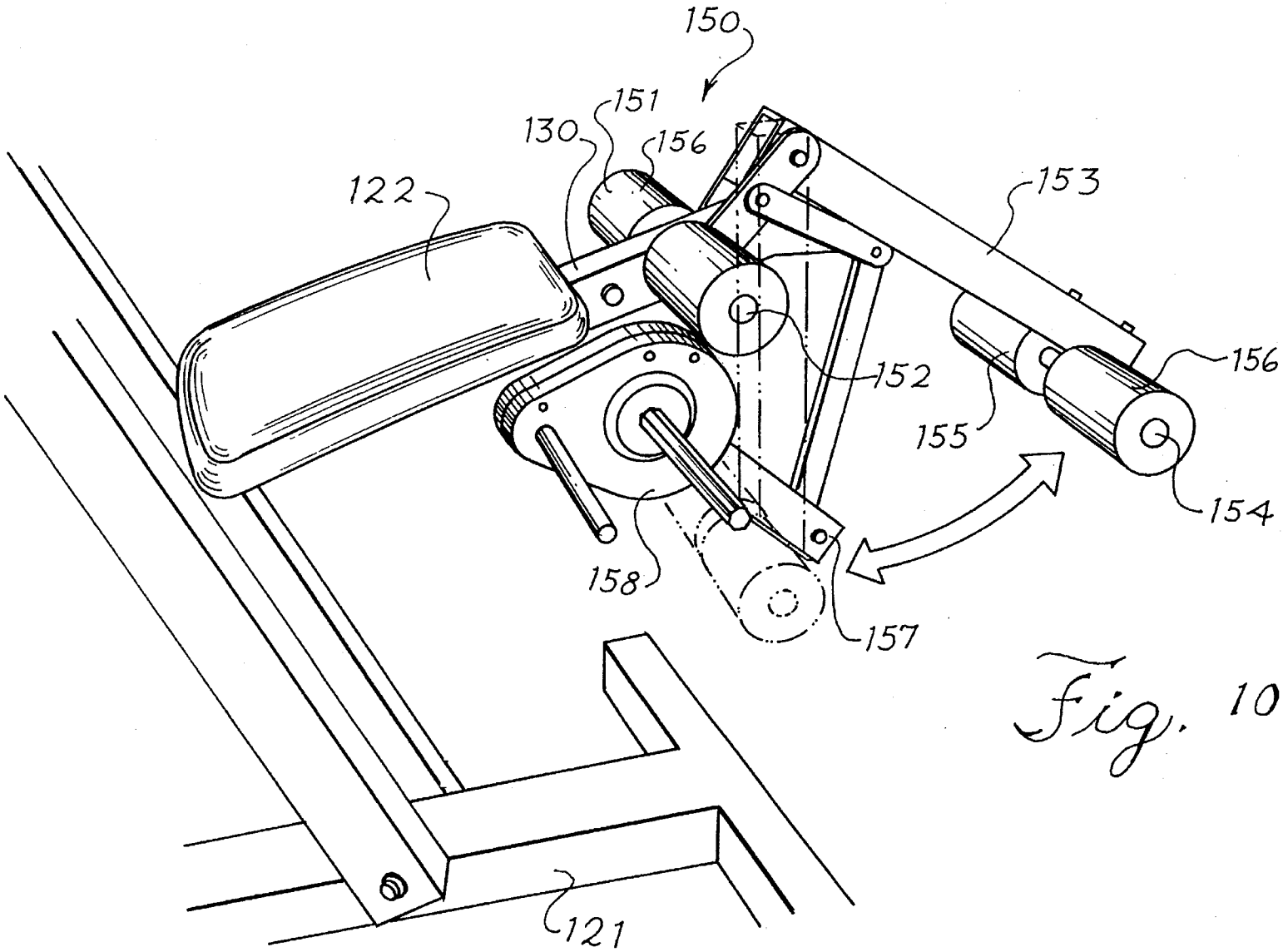
FIG. 10 is a perspective view of a second exercise station of the apparatus of FIG. 8.

The second exercise station 150, illustrated in FIG. 10, also includes a resistance mechanism 158. Horizontal member 130 has two knee supports 151, 152 extending laterally near its distal end. Pivot arm 153 is mounted on the distal end of horizontal member 130. Pivot arm 153 has a pair of ankle supports 154 and 155 mounted on its distal end. Both knee supports 151, 152 and ankle supports 154, 155 may be surrounded by cushioning pads 156. Horizontal member 130 also supports upright member 157. Upright member 157 extends downward toward frame base 121. Upright member 157 supports the resistance member 158 of the second exercise station 150.

Figure 11:
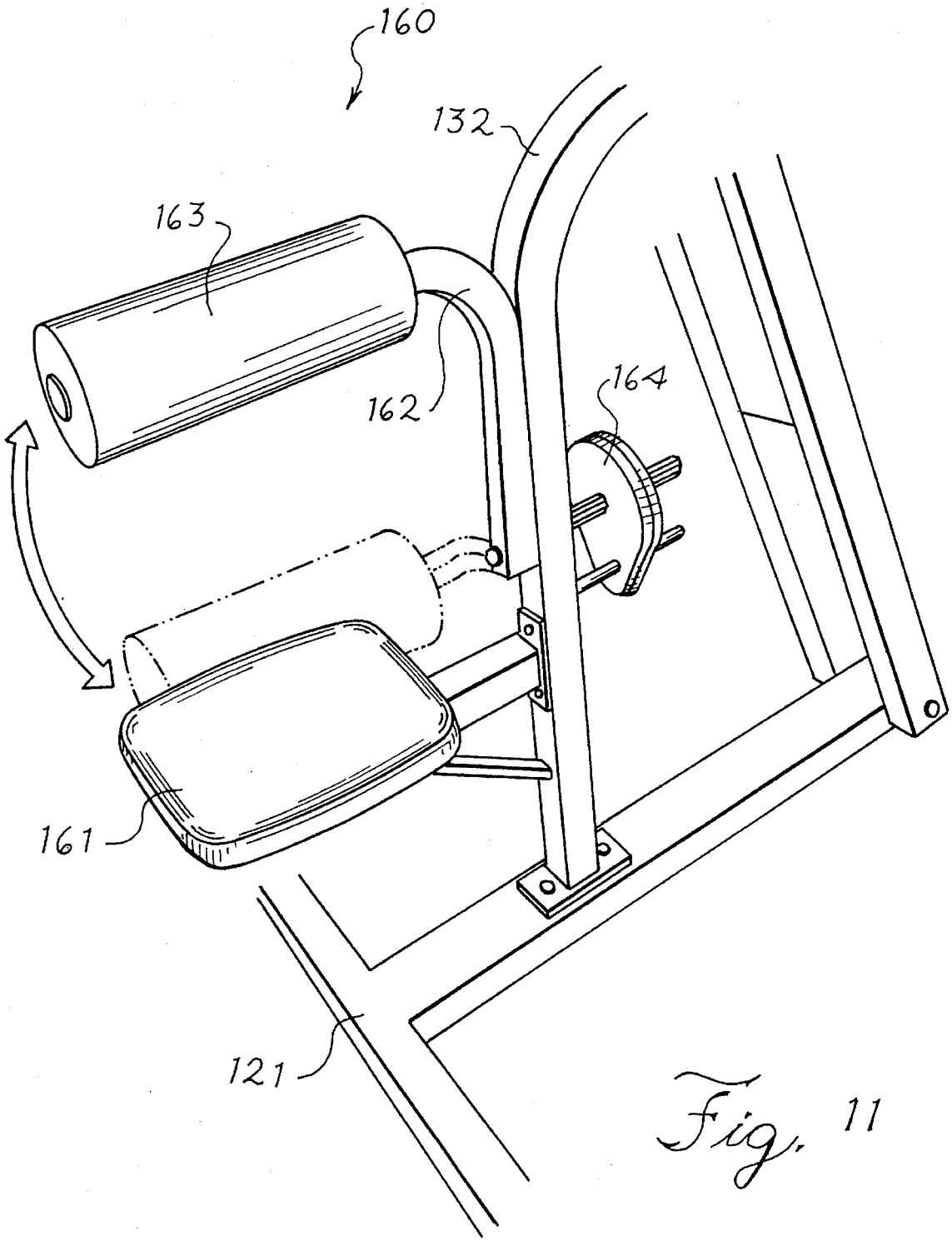
FIG. 11 is a perspective view of a third exercise station of the apparatus of FIG. 8.

FIG. 11 depicts the third exercise station 160. This station comprises a second seat 161 and a pivot arm 162 which are both attached to upright member 132. Pivot arm 162 may have a cushioning pad 163 surrounding its free end. Resistance mechanism 164 is also supported by upright member 132.

The home gym 100 will be better understood by describing the various exercises a user may perform. There are four exercises that may be performed using the first exercise station 140. Returning to FIG. 9A, the user may perform seated bench presses by positioning pivot arm 142 in a downward position. The user sits on the first seat 122 with the user's back against back support 128 and pushes arm levers 143 and 144 out in a forward motion.

Figure 9A:
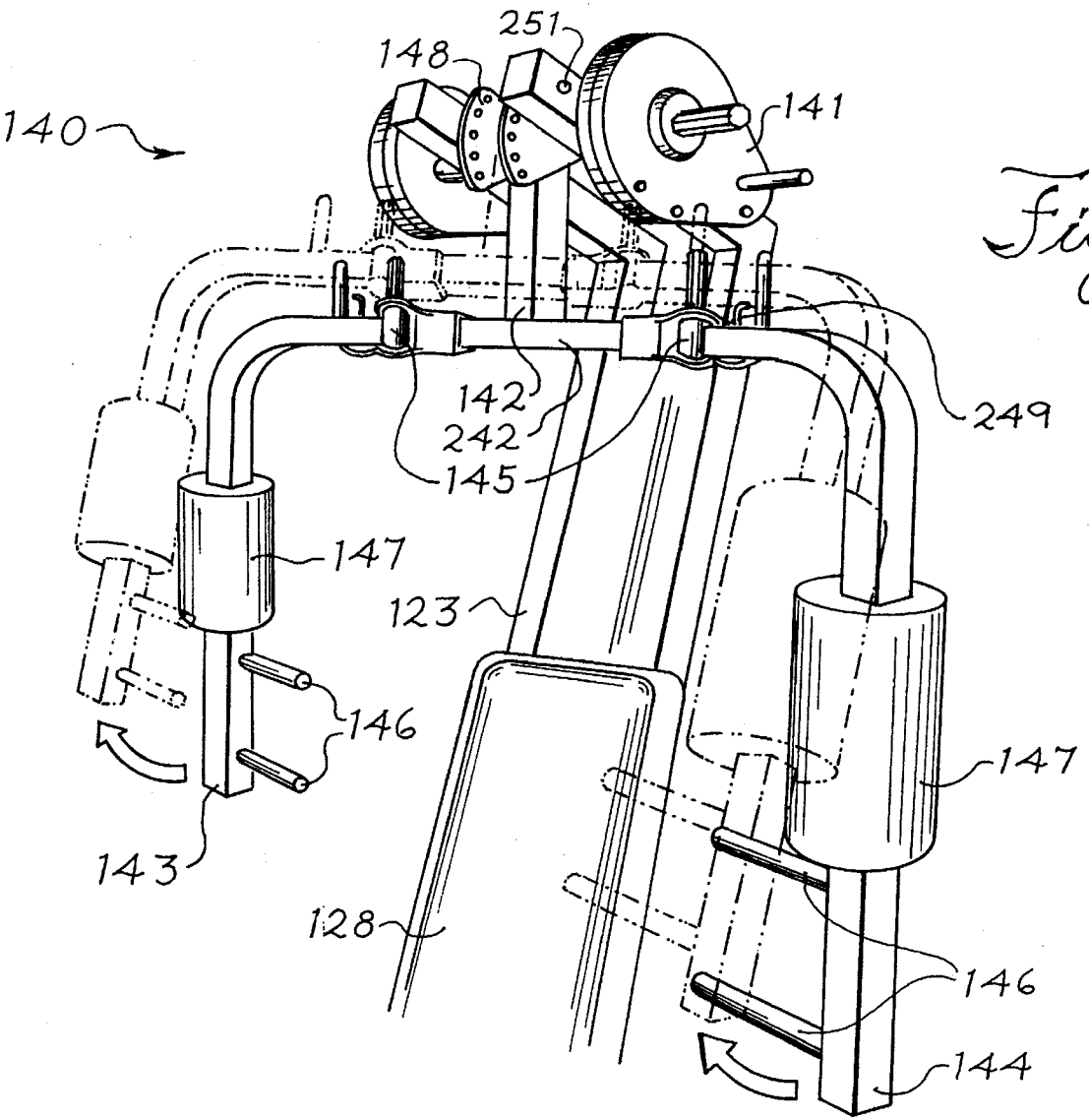
FIGS. 9A–9D are perspective views of the top exercise station of the apparatus of FIG. 8 in different exercise positions.
Figure 9B:
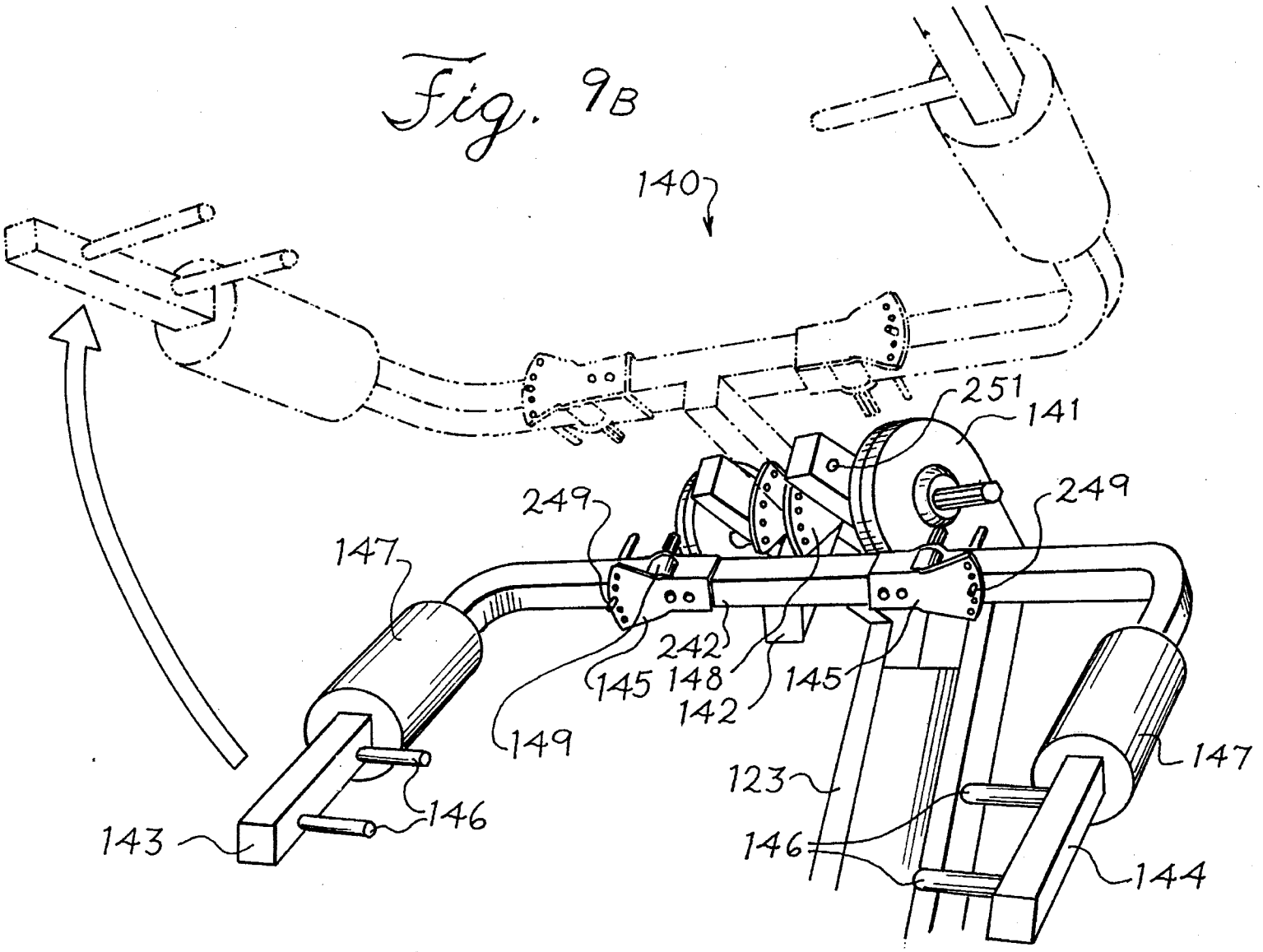

The second exercise, called military presses, is performed with pivot arm 142 in a mid-location, shown in FIG. 9B, causing arm levers 143 and 144 to assume an upward and forward position. Here, the user turns around and faces the machine. While sitting on seat 122, the user presses arm levers 143 and 144 upward.

Figure 9C:
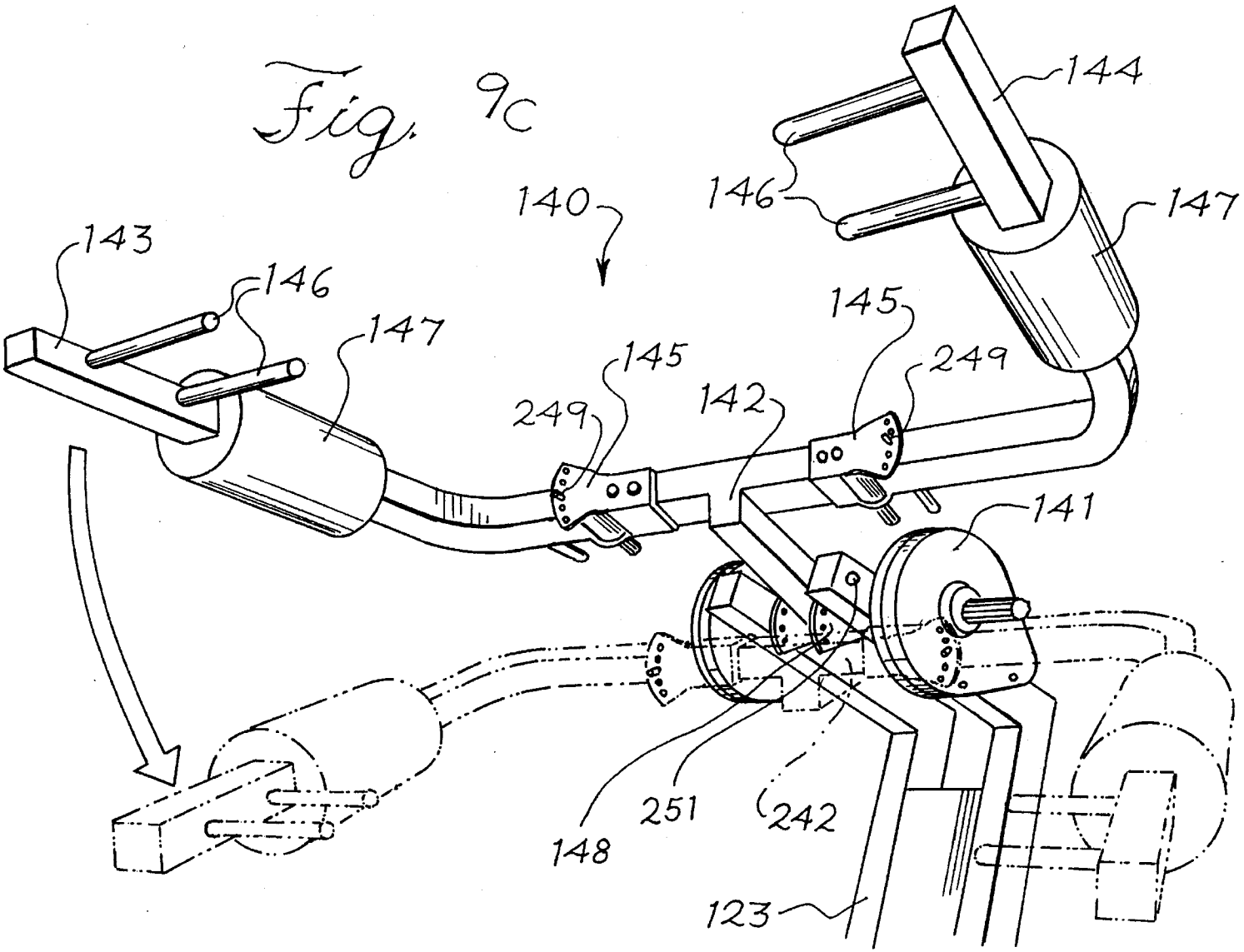
Figure 9D:
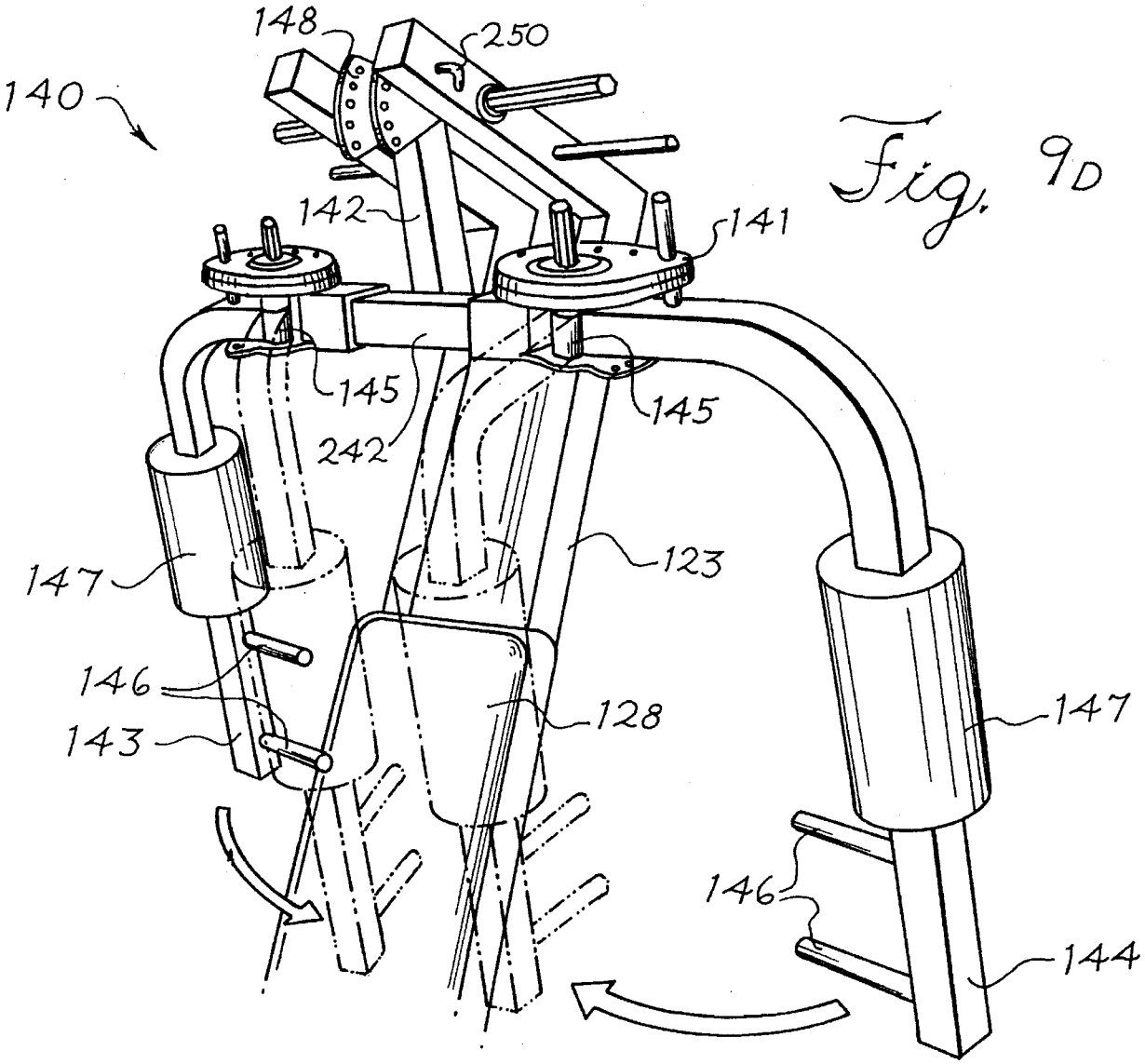

The third exercise, is performed with pivot arm 142 in its uppermost position, as depicted in FIG. 9C. The user still faces the machine. When the user is sitting on seat 122 in the starting position, the user's arms are fully extended over the user's head. The user performs lat pull-downs by reaching up and pulling arm levers 143, 144 downward.

The fourth exercise is performed with the pivot arm 142 in its lowest position, shown in FIG. 9D. The user must make pivot arm 142 stationary by inserting a butterfly lock out pin 250 through aperture 251. Butterfly lock out pin 250 extends through upright bars 124 and 126, positioning plates 148 and pivot arm 142. Pins 249 are removed and resistance mechanisms 141 are moved to their horizontal position on pivot axes 145, which includes a hex-shaped shaft. The user is seated on seat 122 and the user's back rests against back pad 128. The user's elbows are placed against hand grips 146 and the user's forearms rest on the cushioning pads 147. Then, the user pushes the arm levers 143 and 144 toward one another so that user's arms ultimately meet.

The fifth and sixth exercises utilize the second exercise station. The fifth exercise, seated leg extensions, is performed with the user sitting on seat 122 (FIG. 10). The user's knees should be placed over knee supports 151, 152 and the user's ankles should rest behind ankle supports 154 and 155. The user lifts the ankles upward until the legs are virtually horizontal. The sixth exercise, standing reverse leg curls, is performed by standing and facing the machine so that the back of the user's ankles rests against ankle supports 154 and 155. The user pushes one ankle back and upward until the knee bends at a 90° angle. After returning the ankle to its original position, the exercise may be repeated using the opposite leg.

The seventh and eighth exercises utilize the third exercise station 160 (FIG. 11). To perform the seventh exercise, the user sits on seat 161 so that cushioning pad 163 is positioned across the user's chest near the shoulders. The user pushes cushioning pad 163 forward and down toward his knees.

The eighth exercise is accomplished with the user still seated on seat 161. However, this time the user is repositioned so that the cushioning pad 163 rests against the back of the user's shoulders. The back muscles are exercised when the user leans backward.

One variation of the preferred embodiments of this invention lies in varying the number of shafts 60 and support arms 70. In the preferred embodiment, there are an equal number of shafts 60 and support arms 70. However, exercise machines 10 utilizing a form of resistance other than the torsion elastic spring 32 may not utilize support arms 70.

Another variation lies in modifying the positioning element 50 so that it includes a single plate 52 which receives the pin 56.

There are many advantages to the resistance machine 10 of the present invention. The positioning element 50 disclosed makes the pivot arm 40 extraordinarily easy to use. This allows the exercisers to make more efficient use of their time. It also inevitably increases their enjoyment of the machine 10.

Another advantage of the resistance machine 10 of the present invention is that the resistance mechanism 30 is uncomplicated and durable.

A third advantage lies in the fact that the torsion elastic springs 32 allow for a light weight machine. For example, approximately ten pounds of resistance may be obtained from a two pound spring. Therefore, the machine as a whole is much lighter than weight benches utilizing metal weights. The torsion elastic springs 32 also allow the machine to be packaged in a smaller, lighter box. The torsion elastic springs also make the machine easy to use because they are the same size regardless of the amount of weight they provide.

A further advantage of the resistance machine 10 of the present invention is that the corresponding hex configuration of the inner casing 35 of the central bore 34 of the torsion elastic spring 32 and the shaft 60 produces tight tolerance. Also, the support arm 70 keeps the resistance mechanism 30 from rotating about the axis of shaft 60 which ensures that the maximum amount of energy is stored in the rubber during exercise.

Although the present invention has been disclosed with respect to two preferred embodiments, further modifications will be apparent to those skilled in the art. Accordingly, it is not intended that the invention be limited by the disclosure or by such modifications, but instead that its scope should be determined entirely by reference to the claims which follow herein below.

We claim:

1. An exercise apparatus comprising:

a) a frame;

b) at least one elastomeric torsion member for creating resistance mounted to said frame, said elastomeric torsion member mounted in a casing containing a plurality of bores;

c) a shaft pivotally mounted to said frame for conveying torque to said elastomeric torsion member, said shaft being received by one of said bores in the casing of said torsion member;

d) a support arm mounted on said frame for opposing rotation of said elastomeric torsion member about the axis of said shaft, said support arm being received by another of said bores in the casing of said torsion member; and e) a pivot arm mounted on said frame and connected to said shaft such that movement of said pivot arm from a neutral position is resisted by said elastomeric torsion member.

2. An exercise apparatus according to claim 1 wherein said casing is made of plastic.

3. An exercise apparatus according to claim 1 wherein said casing has ribs to provide structure and support and is designed to transmit force between the shaft receiving bore and the elastomeric torsion member.

4. An exercise apparatus comprising:

a) a frame;

b) at least one elastomeric torsion member for creating resistance mounted to said frame;

c) a shaft pivotally mounted to said frame for conveying torque to said elastomeric torsion member, said shaft possessing a hexagonal cross-section;

d) a support arm mounted on said frame for opposing rotation of said elastomeric torsion member about the axis of said shaft; and e) a pivot arm mounted on said frame and connected to said shaft such that movement of said pivot arm from a neutral position is resisted by said elastomeric torsion member.

5. An exercise apparatus according to claim 1 having a plurality of pivot arms and shafts, each pivot arm connected to a different shaft.

6. An exercise apparatus according to claim 1 further comprising a positioning element which allows said neutral position of said pivot arm to be adjusted with respect to the frame without disengaging said elastomeric torsion member from the shaft.

7. An exercise machine according to claim 6 wherein said positioning element comprises at least one plate mounted to said frame, said plate including spaced holes for receiving a pin, such that the neutral position of said pivot arm is adjusted by pinning the pivot arm to the plate through different ones of said spaced holes.

8. An exercise machine according to claim 7 wherein the positioning element comprises two plates with equally spaced holes, the pivot arm being mounted between the two plates.

9. A resistance machine for toning muscles comprising:

a) a frame comprising a base, a first upright member and a second member;

b) a first seat mounted on said first upright member;

c) a first exercise station mounted on said first upright member above said first seat;

d) a second exercise station mounted on said frame adjacent said first seat;

e) a second seat mounted on said second upright member;

f) a third exercise station mounted on said frame adjacent said second seat, wherein each exercise station comprises:

i) at least one elastomeric torsion member for creating resistance;

ii) at least one shaft pivotally mounted to said frame for conveying torque to said elastomeric torsion member;

iii) at least one support arm mounted on said frame for opposing rotation of said elastomeric torsion member about the axis of said shaft;

iv) a pivot arm mounted onto said frame and connected to said shaft such that movement of said shaft from a neutral position is resisted by said elastomeric torsion member; and g) at least one of said first, second and third exercise stations, comprising a positioning element which allows said pivot arm to be adjusted with respect to the frame, independent of said elastomeric torsion member, so as to vary the neutral position of the pivot arm.

10. The resistance machine according to claim 9 wherein the first upright member comprises two spaced, parallel bars and said second upright member is connected to the first upright member at a midpoint of the first upright member.

11. An exercise apparatus comprising:

a) a frame;

b) at least one elastomeric torsion member for creating resistance mounted to said frame; said torsion member having a central bore therethrough, said bore being lined with a metal casing having a hole therethrough;

c) a shaft pivotally mounted to said frame for conveying torque to said elastomeric torsion member, the cross-sectional shape of said shaft corresponding to the shape of the hole in said bore of said torsion member;

d) a support arm mounted on said frame for opposing rotation of said elastomeric torsion member about the axis of said shaft; and e) a pivot arm mounted on said frame and connected to said shaft such that movement of said pivot arm from a neutral position is resisted by said elastomeric torsion member.

12. An exercise apparatus according to claim 1 wherein the plurality of bores comprises two bores.

13. An exercise apparatus according to claim 1 wherein the elastomeric torsion member comprises a torsion elastic spring.

14. An exercise apparatus according to claim 4 wherein the elastomeric torsion member comprises a torsion elastic spring.

15. A resistance machine according to claim 9 wherein the elastomeric torsion member comprises a torsion elastic spring.

16. An exercise apparatus according to claim 11 wherein the elastomeric torsion member comprises a torsion elastic spring.

* * * * *